US005615874A

United States Patent [19]

Parthasarathy et al.

[11] Patent Number: 5,615,874

[45] Date of Patent: Apr. 1, 1997

[54] APPARATUS AND METHOD FOR SEPARATING SHEETS OF MEDIA BY CREATING PRIMARY AND SECONDARY STACK DEPRESSIONS

[75] Inventors: Baskar Parthasarathy; Pui W. Huang; Yuh W. Sum; Lian H. Ng, all of Singapore, Singapore

[73] Assignee: Hewlett-Packard Company, Palo Alto, Calif.

[21] Appl. No.: 560,220

[22] Filed: Nov. 21, 1995

[51] Int. Cl.[6] ..... B65H 3/52; B65H 1/02

[52] U.S. Cl. ..... 271/121; 271/127; 271/149; 271/160; 271/161

[58] Field of Search ..... 271/121, 127, 271/149, 160, 161, 167, 37, 126

[56] References Cited

U.S. PATENT DOCUMENTS

| | | | |
|---|---|---|---|
| 3,687,448 | 8/1972 | Vora | 271/161 X |
| 4,113,244 | 9/1978 | Ruenzi | 271/121 X |
| 4,269,403 | 5/1981 | Stephens et al. | 271/121 X |
| 4,647,030 | 3/1987 | Tomita | 271/127 X |
| 4,995,601 | 2/1991 | Ohashi | 271/127 |
| 5,183,248 | 2/1993 | Okada et al. | 271/121 X |
| 5,232,214 | 8/1993 | Matsuura et al. | 271/127 |
| 5,340,098 | 8/1994 | Gunderson | 271/127 X |
| 5,480,247 | 1/1996 | Saikawa et al. | 271/126 X |

FOREIGN PATENT DOCUMENTS

| | | | |
|---|---|---|---|
| 102444 | 6/1982 | Japan | 271/121 |
| 22228 | 2/1983 | Japan | 271/149 |
| 1640 | 1/1988 | Japan | 271/127 |
| 104537 | 4/1989 | Japan | 271/121 |
| 127330 | 5/1990 | Japan | 271/121 |
| 95029 | 4/1991 | Japan | 271/161 |
| 147650 | 6/1991 | Japan | 271/121 |
| 179540 | 6/1994 | Japan | 271/161 |

*Primary Examiner*—Boris Milef

[57] ABSTRACT

A media separation system is provided for separating individual sheets from a stack of media. The media separation system has a pressure plate positioned at an angle to support the stack of sheets along an incline. The pressure plate has an upper and lower end, with a relieved area formed in the lower end of the pressure plate. The media separation system also has a pick roller disposed in juxtaposition to the relieved area of the pressure plate to engage and separate a top sheet from the stack of sheets. The pick roller has a width that is more narrow than that of the relieved area in the pressure plate. A spring-like mechanism is provided to urge the pressure plate toward the pick roller to cause the pick roller and the pressure plate to work cooperatively to depress the sheets of media beneath the pick roller into the relieved area of the pressure plate. This causes formation of a primary depression in the stack of sheets. The media separation system further includes a ribbed surface positioned elevationally below the pressure plate and pick roller to support and register leading edges of the stack of sheets. The ribbed surface has a raised rib positioned centrally beneath the pick roller to create a secondary depression in the stack of sheets that bows in an opposite direction from the primary depression. The dual depressions create a distinct shape that enables the top sheet to separate easily from the stack when the pick roller is rotated.

15 Claims, 5 Drawing Sheets

APPARATUS AND METHOD FOR SEPARATING SHEETS OF MEDIA BY CREATING PRIMARY AND SECONDARY STACK DEPRESSIONS

TECHNICAL FIELD

This invention relates to media separation systems for printers, photocopiers, facsimile machines, and the like.

BACKGROUND OF THE INVENTION

Printers, photocopiers, facsimile machines, and other electronic printing devices all employ media handling systems to guide media from an input source to an output destination. Familiar types of media include paper, labels, and transparencies. The media can be produced in different forms. For instance, paper can be produced as a continuous roll, with perforations defining pages for separation after printing. Alternatively, paper can be manufactured as stacks of separate sheets which are fed individually into the device prior to printing. Media handling systems often vary in design depending upon the form of the media (e.g., continuous or individual sheets).

To handle individual sheets, a media handling system typically include a media separation system to separate individual sheets from the stack of sheets for input to the printing device. The media separation system enables automatic sheet feeding whereby individual sheets are supplied one at a time from a bin or container that holds a stack of sheets to the printing device.

The ability to efficiently and repeatedly separate a single sheet from a stack of like media is a difficult design task. This difficulty is magnified when you consider that the stack is always changing in thickness, as sheets are used or replenished. As a result, conventional media separation systems are often technically sophisticated and employ a large number of parts, thereby increasing costs to the overall printing device.

There is a trend toward making printing devices smaller, lighter weight, and portable. As part of this trend, there is a need to devise media separation systems that employ fewer parts, with less moving components, and which are less expensive.

SUMMARY OF THE INVENTION

According to one aspect of this invention, a media separation system is provided for separating individual sheets from a stack of media. The media separation system has a pressure plate positioned at an angle to support the stack of sheets along an incline. The pressure plate has an upper and lower end, with a relieved area formed in the lower end of the pressure plate. The media separation system also has a pick roller disposed in juxtaposition to the relieved area of the pressure plate to engage and separate a top sheet from the stack of sheets. The pick roller has a width that is more narrow than that of the relieved area in the pressure plate. A spring-like mechanism is provided to urge the pressure plate toward the pick roller to cause the pick roller and the pressure plate to work cooperatively to depress the sheets of media beneath the pick roller into the relieved area of the pressure plate. This causes formation of a primary depression in the stack of sheets.

In the absence of any media, the pick roller extends partially into the relieved area and contacts an edge of the pressure plate about the relieved area. The point of contact between the pick roller surface and edge is not at the tangential point of the roller that is tangential to the angle of incline of the pressure plate. Instead, the pick roller is positioned such that the tangential point on the pick roller surface is spaced a distance from the upper edge of the pressure plate to allow a portion of the roller to extend into the wider relieved area.

The media separation system further includes a ribbed surface positioned elevationally below the pressure plate and pick roller to support and register leading edges of the stack of sheets. The ribbed surface has a raised rib positioned centrally beneath the pick roller to create a secondary depression in the stack of sheets that bows in an opposite direction from the primary depression. The dual depressions create a distinct shape that enables the top sheet to separate easily from the stack when the pick roller is rotated.

According to another aspect of this invention, a method for separating sheets of media is described. This method includes an initial step of disposing a stack of sheets of media between a pressure plate and a pick roller. Once loaded, a portion of the stack of sheets is depressed beneath the pick roller into a relieved area formed in the pressure plate about the pick roller to create a primary depression in the stack of sheets. Concurrently, the leading edges of the stack of sheets are deflected upward to create a secondary depression in the stack of sheets that bows in an opposite direction from the primary depression to create the unique dual depression shape. Finally, the pick roller is rotated to pick and advance a top sheet from the stack of sheets.

BRIEF DESCRIPTION OF THE DRAWINGS

FIG. 2 shows the media separation system without media loaded therein.

FIG. 4 shows a stack of sheets loaded in the media separation system.

DETAILED DESCRIPTION OF THE PREFERRED EMBODIMENT

Figure 1:
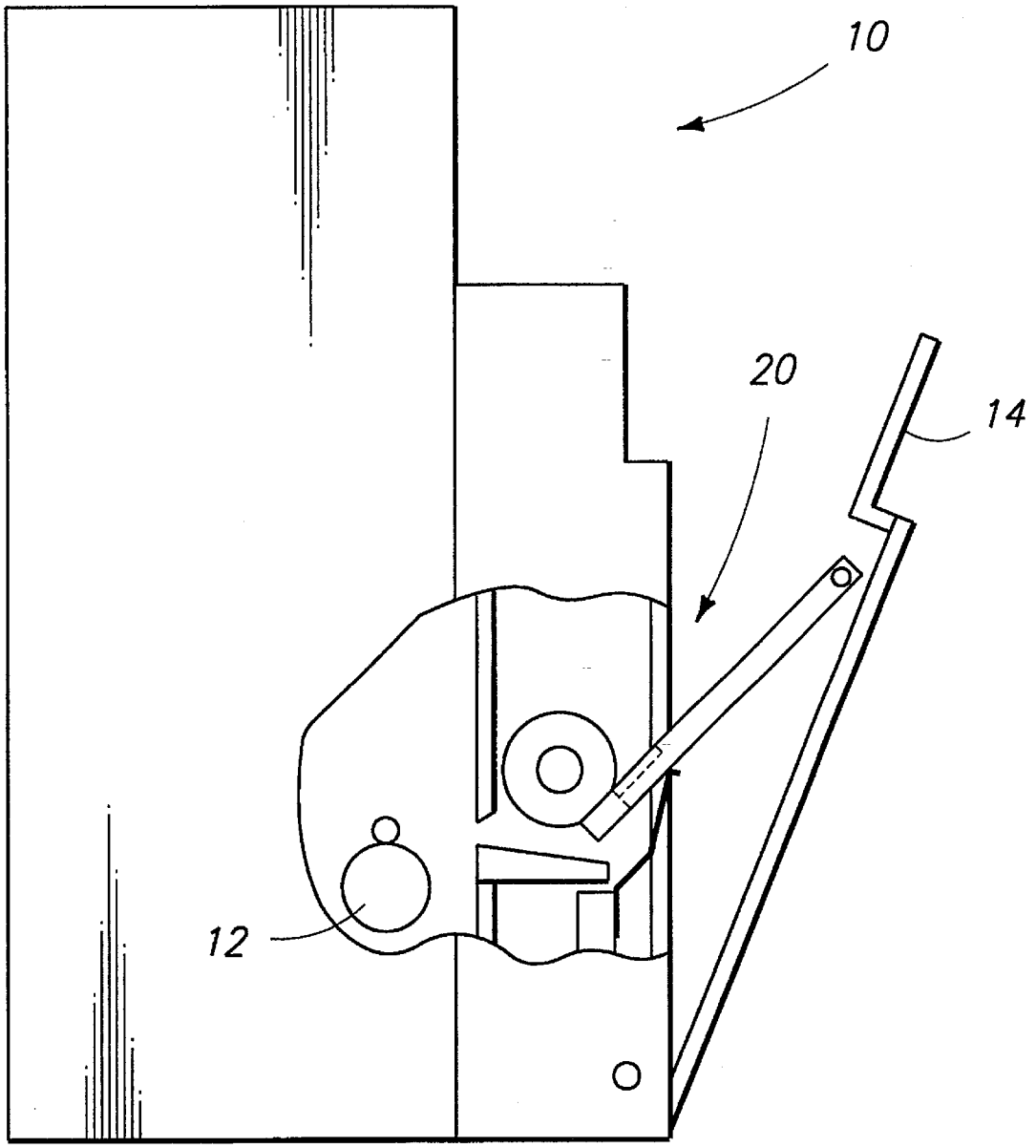
FIG. 1 is a side view of a printer, with partial cut away to reveal a media separation system configured according to an aspect of this invention.

FIG. 1. shows a printer 10 that is small, lightweight, and portable. Printer 10 has a media separation system 20 that separates and feeds individual sheets of media (e.g., paper, adhesive-backed labels, transparencies, and other printable matter) to a printing unit, of which a drive roller 12 is shown. The drive roller 12 receives the individual sheets from the media separation system 20 and drives them through an internal paper path and passed a printing element (e.g., a rotating photoelectric drum, ink-jet nozzles, dot-matrix printhead, etc.), which are not shown. An external hinged door 14 is operatively closed to protect the media separation system 20 during transportation, or opened to expose the system 20 during operation.

Figure 2:
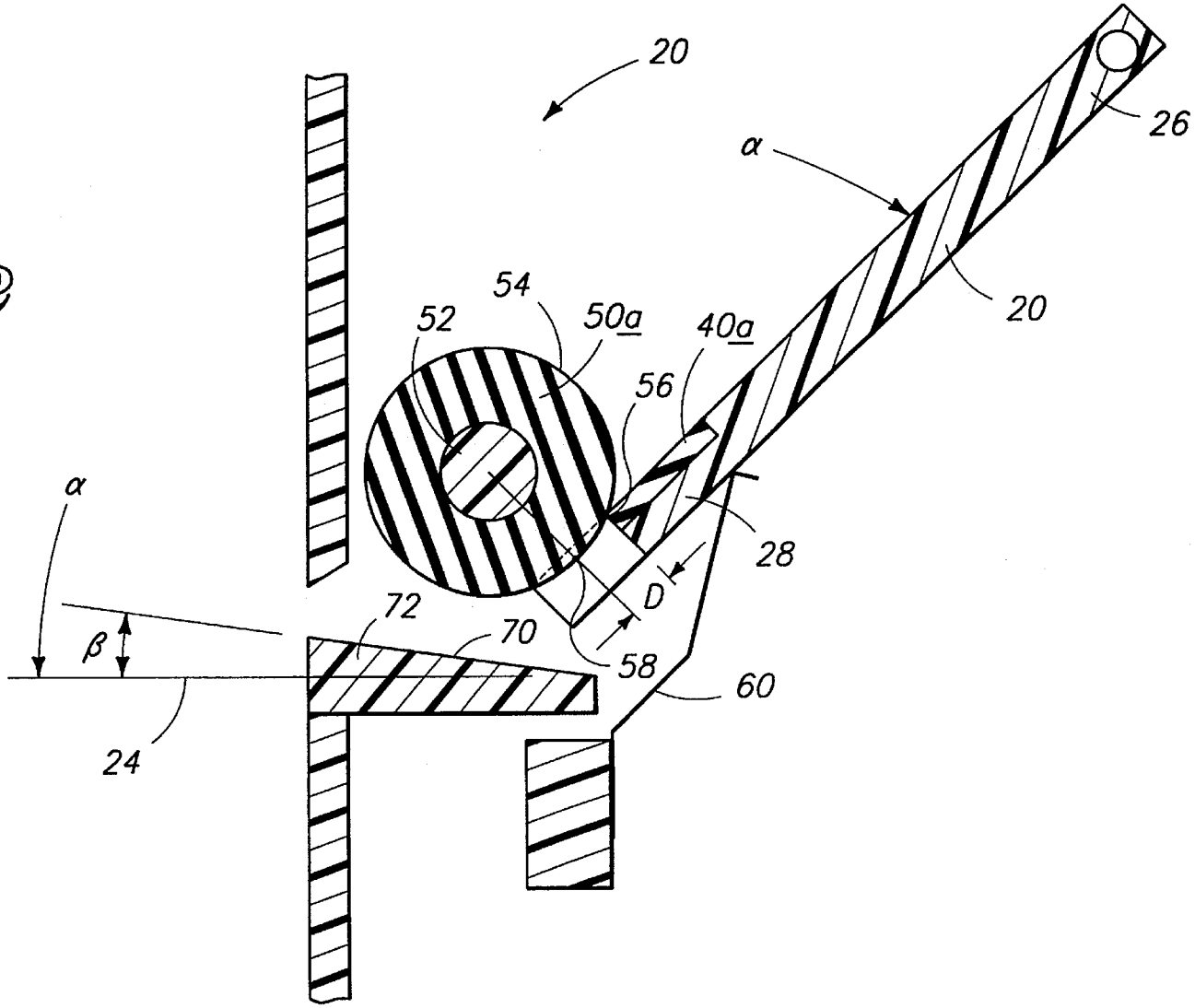
FIG. 2 is a cross-sectional side view of the media separation system taken through line 2—2 in FIG. 3.
Figure 3:
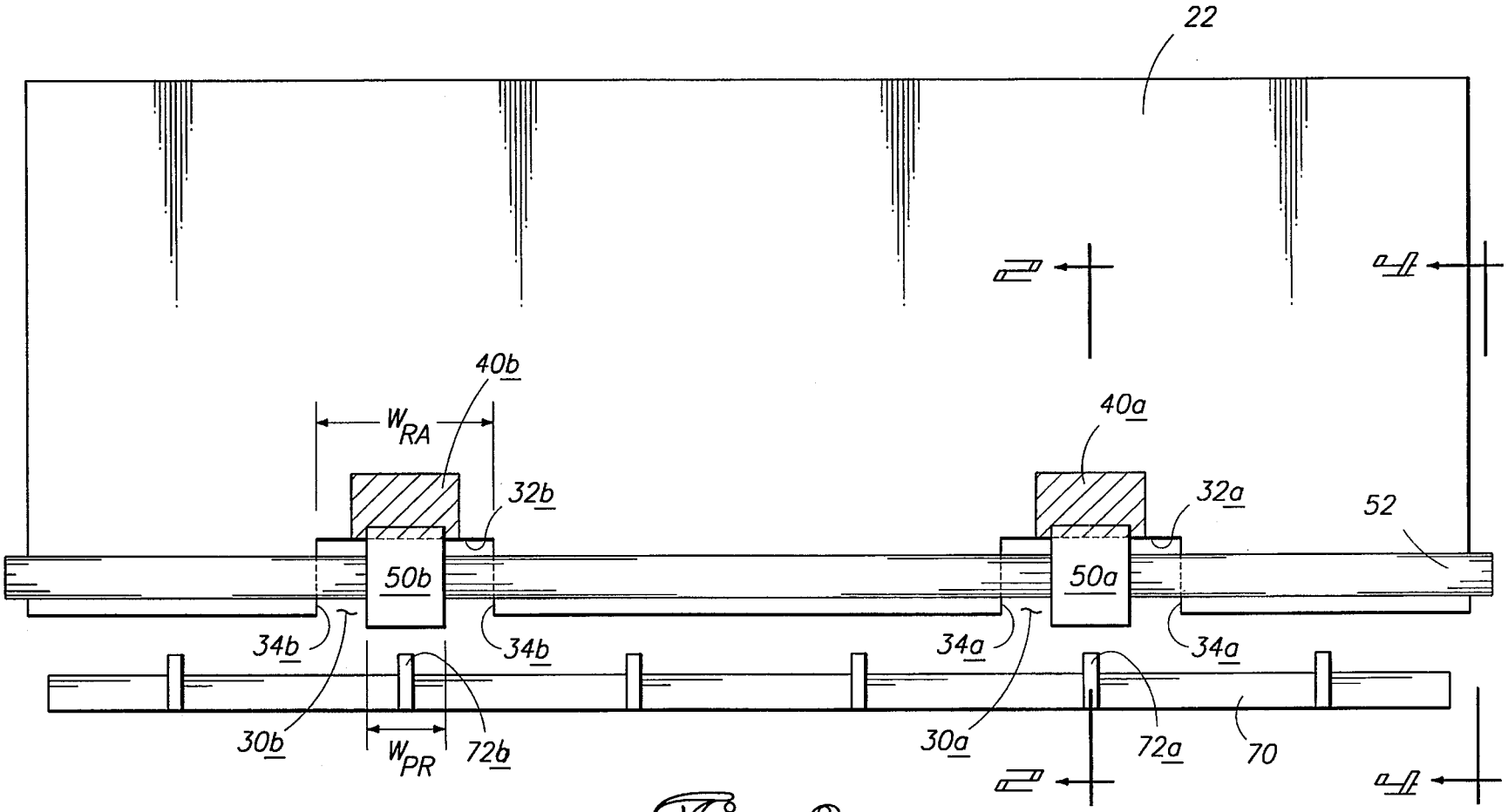
FIG. 3 is a top view of the media separation system.

FIGS. 2 and 3 show the media separation system 20 is more detail. Media separation system 20 has a pressure plate 22 to support a stack of individual sheets of media (not shown in these figures, but shown in FIGS. 4 and 5). Pressure plate 22 is positioned at an angle α to support the stack of sheets along an incline. Preferably, angle α is an obtuse angle relative to horizontal reference plane 24 of approximately 135°. Pressure plate 22 has an upper end 26 and a lower end 28.

As shown in FIG. 3, two relieved areas 30(*a*) and 30(*b*) are formed in the lower end of the pressure plate. In the illustrated embodiment, the relieved areas 30(*a*) and 30(*b*) are cut out areas notched in the lower end 28 of pressure plate 22. These cut out areas 30(*a*) and 30(*b*) are defined by respective upper edges 32(*a*) and 32(*b*) and side edges 34(*a*) and 34(*b*) of the pressure plate. The relieved areas have a width $W_{RA}$ between side edges 34(*a*). In other embodiments, relieved areas 30(*a*) and 30(*b*) might be formed as recesses, or the like, in the pressure plate.

Two skid-resistant pads 40(*a*) and 40(*b*) are mounted to pressure plate 22 adjacent to respective relieved areas 30(*a*) and 30(*b*). The skid-resistant pads 40(*a*) and 40(*b*) provide friction for resisting movement of the stack of sheets during separation to avoid picking up and advancing multiple sheets. These pads are preferably formed of rubber or an elastomer. The skid-resistant pads 40(*a*) and 40(*b*) help form the upper edges 32(*a*) and 32(*b*) of the pressure plate about the relieved areas 30(*a*) and 30(*b*).

Media separation system 20 also includes a pair of pick rollers 50(*a*) and 50(*b*) to engage and separate a top sheet from the stack of sheets supported on the pressure plate 22. As shown in FIG. 3, pick rollers 50(*a*) and 50(*b*) are laterally spaced along drive rod 52 in juxtaposition with corresponding relieved areas 30(*a*) and 30(*b*). Pick rollers 50(*a*) and 50(*b*) have a width $W_{PR}$ which is more narrow than the width $W_{RA}$ of corresponding relieved areas 30(*a*) and 30(*b*).

As best seen in FIG. 2, each pick roller, as represented by pick roller 50(*a*), is positioned slightly downstream from the primary support surface of pressure plate 22 so that a portion of the pick roller extends into the relieved area 30(*a*) in the absence of media. More particularly, the pick roller is positioned so that its outer surface 54 contacts skid-resistant pad 40(*a*) at a point 56 that is not tangential to the inclination angle α. Rather, the tangential point 58 on outer surface 54 is spaced a distance D along the incline from the upper edge 32(*a*) of the pressure plate as formed by pad 40(*a*). As an example, distance D is about 4 mm.

A metal spring plate 60 is provided to force the pressure plate 22 toward the pick rollers 50(*a*) and 50(*b*). The applied force ensures that the stack of sheets positively contact the pick rollers for separation. The force induced by the spring plate 60 also causes the pressure plate 22 and pick rollers 50(*a*) and 50(*b*) to work cooperatively to depress the sheets of media beneath the pick rollers into the wider relieved areas 30(*a*) and 30(*b*). The positioning and width of the pick rollers relative to the relieved areas enable creation of distinct primary depressions in the stack of sheets that dimple or bow in a first direction into the relieved areas. The degree of depression varies in conjunction with the thickness of the stack of sheets (e.g., less depression with thicker stack), the rigidity of the media (e.g., less depression with more rigid media), and the strength of spring plate 60 (e.g., less depression with weaker spring).

It is noted that other forms of spring-like mechanisms can be used in place of spring plate 60, including traditional tension or compression springs, elastomer members, and the like. Additionally, the spring-like mechanism can be alternatively configured to urge the pick rollers toward a stationary pressure plate, or to urge the pick rollers and pressure plate toward one another.

Media separation system 20 has a sloping ribbed surface 70 positioned elevationally below the pressure plate 22 and pick rollers 50(*a*) and 50(*b*) to support and register leading edges of the stack of sheets. The ribbed surface 70 is sloped at an angle β that is acute relative to the horizontal reference plane 24 (FIG. 2). Preferably, the acute angle β is approximately 8°. The sloped surface 70 functions as a resistive surface to improve media separation as well as a stack reference surface for registering the leading edges of the sheets.

As best seen in FIG. 3, the ribbed surface 70 has raised ribs 72(*a*) and 72(*b*) positioned centrally beneath respective pick roller 50(*a*) and 50(*b*). The raised ribs 72(*a*) and 72(*b*) create secondary depressions in the stack of sheets that bow upward in an opposite direction from the primary depressions of the stack induced by the pick rollers and relieved areas. The dual depressions create a distinct shape that enables the pick rollers 50(*a*) and 50(*b*) to positively engage and separate the top sheet from the stack when the pick rollers are rotated.

Figure 4:
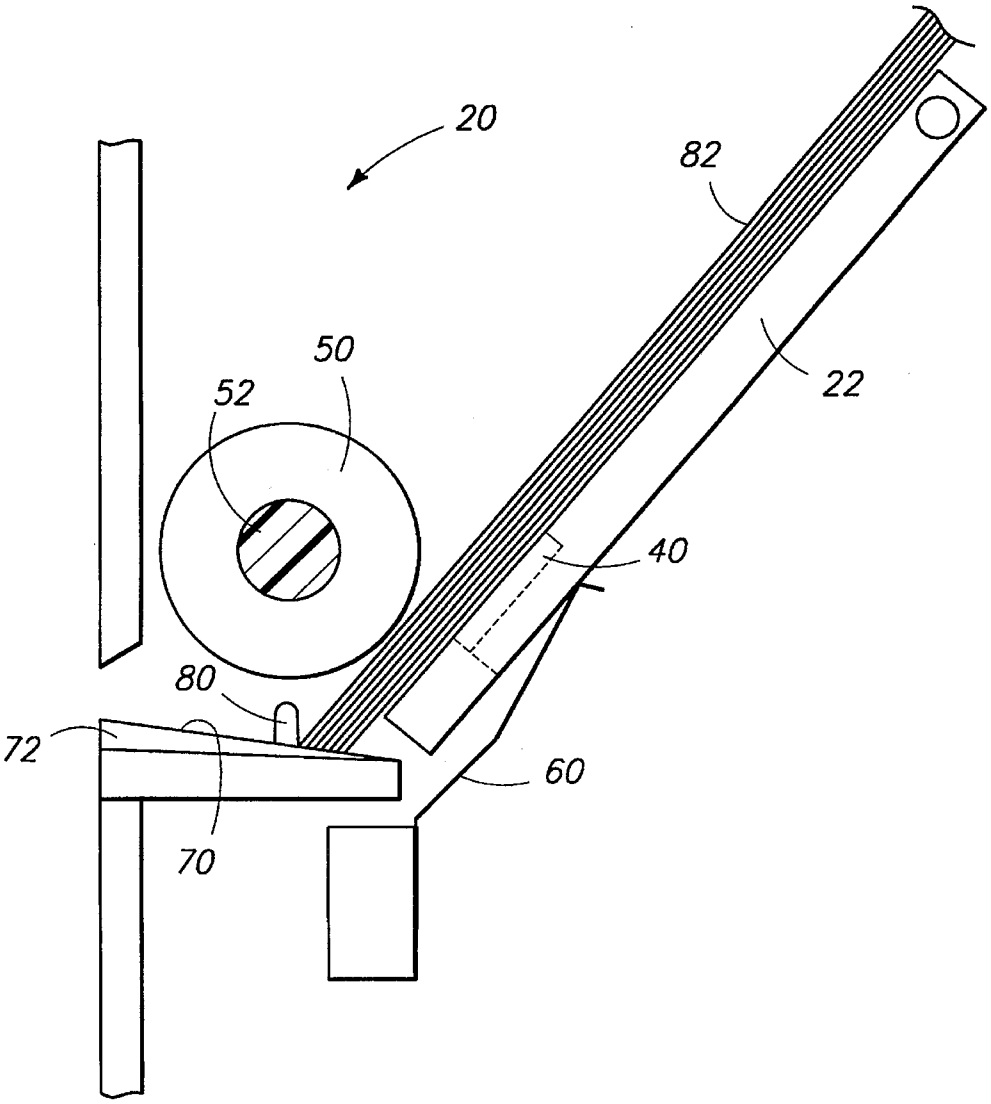
FIG. 4 is a side view of the media separation system taken though line 4—4 in FIG. 3.
Figure 5:
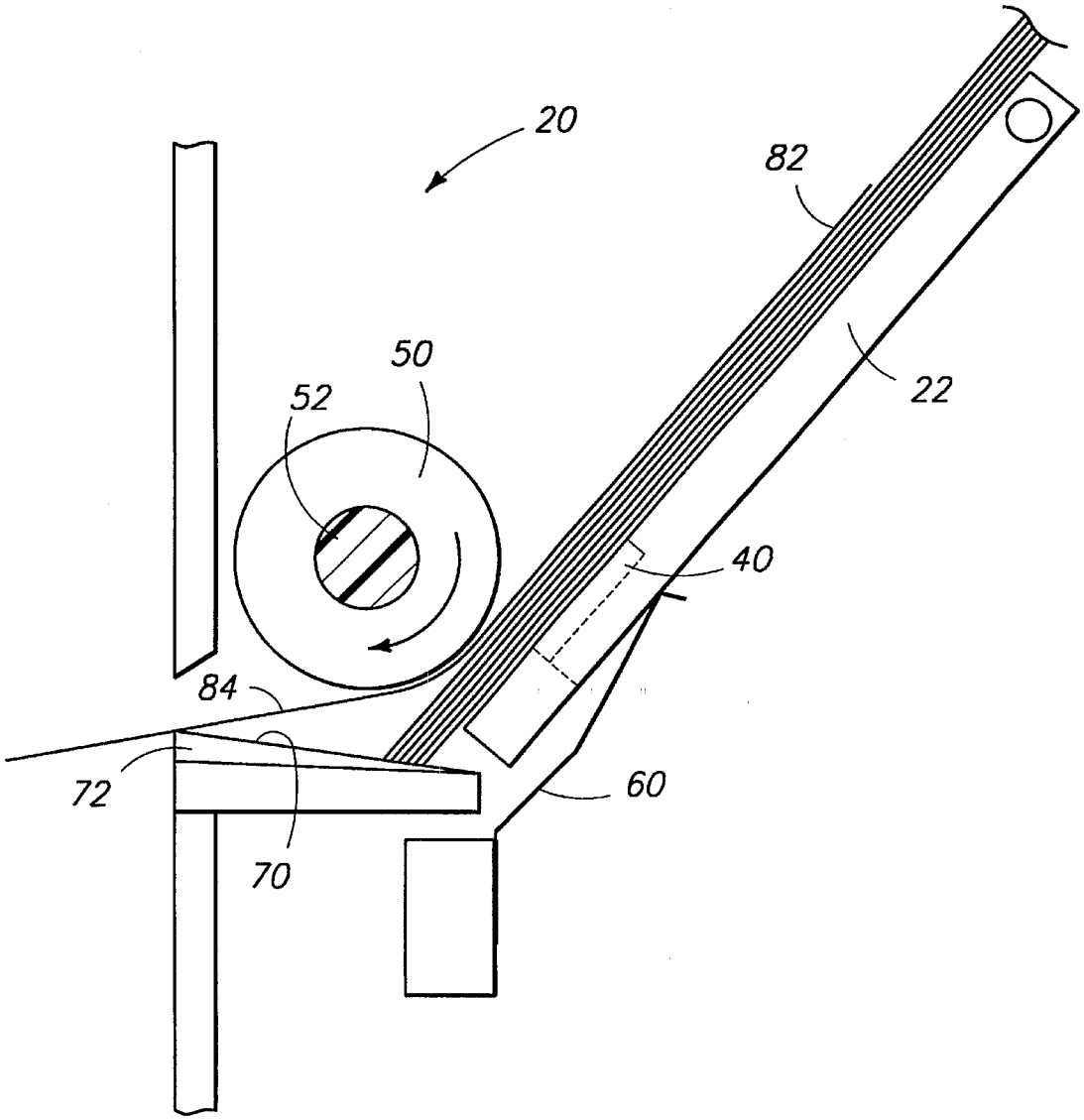
FIG. 5 is a side view of the media separation system similar to FIG. 4, but showing separation of a top sheet from the stack of sheets.

FIGS. 4 and 5 show the general operation of the media separation system 20. First, the pressure plate 22 is opened and locked in a load state by a cam operated lever (not shown). An indexing lever 80 (FIG. 4) projects above the sloped ribbed surface 70 to act as an initial media stop and registration mark. When open, a stack 82 of individual sheets of media are loaded onto the pressure plate 22, with the leading edges resting against surface 70 and indexing lever 80. The cam operated lever is then released and the indexing lever 80 is withdrawn.

The spring plate 60 forces pressure plate 22 toward the pick rollers 50. This action causes depression of portions of the stack 82 beneath the pick rollers (generally referenced as numeral "50") into the relieved areas of the pressure plate to create the primary depressions in the stack 82. Concurrently, the leading edges of the sheets in stack 82 are deflected upwardly in a bowed manner by the raised ribs 72 to create the secondary depression.

As shown in FIG. 5, the pick rollers 50 are rotated clockwise to advance the top sheet 84 from the stack 82. The unique dual depressions in the media caused by the pick rollers, relieved areas, and ribbed surface enable the pick rollers to easily separate the top sheet from the stack. Once the top sheet 84 is separated, it does not contact the ribbed surface 70 due to the upward slope of the surface. The top sheet instead forms an arc path as shown in FIG. 5 as it advances toward the drive roller 12 (FIG. 1).

The media separation system is advantageous because it effectively separates a single sheet of media from a stack without employing a large number of parts or moving components. In fact, the pick rollers/rod assembly is the only active moving component. The pressure plate is passively moved under mechanical force of the spring plate. The ease of separation is achieved primarily through the unique depressions created in the stack through mechanical configuration of the relieved areas in the pressure plate, the sloping ribbed surface, and the positioning of the pick rollers relative to the relieved areas. The low number of parts (with few moving components) results in a lower manufacturing cost and assembly expense. Moreover, the design is compact and can be employed in small, portable printing devices.

In compliance with the statute, the invention has been described in language more or less specific as to structure and method features. It is to be understood, however, that the invention is not limited to the specific features described, since the means herein disclosed comprise exemplary forms of putting the invention into effect. The invention is, therefore, claimed in any of its forms or modifications within the proper scope of the appended claims appropriately interpreted in accordance with the doctrine of equivalents and other applicable judicial doctrines.

We claim:

1. A media separation system for separating sheets of media, the media separation system comprising:

a pressure plate positioned at an angle to support a stack of individual sheets of media along an incline, the pressure plate having a relieved area formed therein;

a pick roller disposed in juxtaposition to the relieved area of the pressure plate and having an outer surface to engage and separate a top sheet from the stack of sheets; and a ribbed surface positioned elevationally below the pressure plate and pick roller and aligned vertically beneath the pick roller to support leading edges of the stack of sheets prior to sheet separation, the ribbed surface having at least one raised rib positioned centrally beneath the pick roller to cause formation of a depression in the sheets of media.

2. A media separation system as recited in claim 1, wherein:

the pressure plate has an upper end and a lower end; and the relieved area comprises a cut out area formed in the lower end of the pressure plate.

3. A media separation system as recited in claim 1, further comprising multiple relieved areas formed in the pressure plate and multiple pick rollers disposed in juxtaposition with corresponding ones of the relieved areas.

4. A media separation system as recited in claim 1, further comprising a skid-resistant pad mounted to the pressure plate adjacent to the relieved area.

5. A media separation system as recited in claim 1, wherein:

the angle of the pressure plate relative to a horizontal reference plane is an obtuse angle; and the raised rib of the ribbed surface slopes at an acute angle relative to the horizontal reference plane.

6. A media separation system as recited in claim 1, further comprising a spring to urge the pressure plate toward the pick roller.

7. A printer comprising the media separation system as recited in claim 1.

8. A media separation system for separating sheets of media, the media separation system comprising:

a pressure plate positioned at an angle to support a stack of individual sheets of media along an incline, the pressure plate having a relieved area formed therein;

a pick roller disposed in juxtaposition to the relieved area of the pressure plate to engage and separate a top sheet from the stack of sheets, the pick roller having a width that is more narrow than a width of the relieved area in the pressure plate;

a spring-like mechanism urging at least one of the pick roller or the pressure plate toward the other to cause the pick roller and the pressure plate to work cooperatively to depress the sheets of media beneath the pick roller into the relieved area of the pressure plate; and a ribbed surface positioned elevationally below the pressure plate and pick roller and aligned vertically beneath the pick roller to support leading edges of the stack of sheets prior to sheet separation, the ribbed surface having a raised rib positioned centrally beneath the pick roller to cause formation of a secondary depression in the sheets of media.

9. A media separation system as recited in claim 8, wherein:

the pressure plate has an upper end and a lower end; and the relieved area comprises a cut out area formed in the lower end of the pressure plate.

10. A media separation system as recited in claim 8, wherein the spring-like mechanism comprises a spring plate mounted to force the pressure plate toward the pick roller.

11. A media separation system as recited in claim 8, further comprising multiple relieved areas formed in the pressure plate and multiple pick rollers disposed in juxtaposition with corresponding ones of the relieved areas.

12. A media separation system as recited in claim 8, further comprising a skid-resistant pad mounted to the pressure plate adjacent to the relieved area.

13. A media separation system as recited in claim 8, wherein:

the angle of the pressure plate relative to a horizontal reference plane is an obtuse angle; and the raised rib of the ribbed surface slopes at an acute angle relative to the horizontal reference plane.

14. A printer comprising the media separation system as recited in claim 8.

15. A method for separating sheets of media, the method comprising the following steps: – disposing a stack of sheets of media between a pressure plate and a pick roller;

depressing a portion of the stack of sheets beneath the pick roller in a first direction into a relieved area formed in the pressure plate about the pick roller to create a primary depression in the stack of sheets;

deflecting a portion of leading edges of the stack of sheets that is located beneath the pick roller in a second direction substantially opposite to the first direction to create a secondary depression in the stack of sheets, the primary and secondary depressions creating a shape that enables the pick roller to engage and separate a top sheet from the stack of sheets; and rotating the pick roller to advance the top sheet from the stack of sheets.

* * * * *